United States Patent [19]

Roach

[11] 4,133,114

[45] Jan. 9, 1979

[54] BUTT HINGE SCREW LOCATION MARKING TEMPLATE

[76] Inventor: Carl L. Roach, 5912 Marlin, El Paso, Tex. 79924

[21] Appl. No.: 799,647

[22] Filed: May 23, 1977

[51] Int. Cl.[2] ..... E05B 17/06

[52] U.S. Cl. ..... 33/197; 16/128 R; 33/180 R

[58] Field of Search ..... 33/189, 197, 194, 180 R; 16/128 R, 137

[56] References Cited

U.S. PATENT DOCUMENTS

| | | | |
|---|---|---|---|
| 290,464 | 12/1883 | Parnall | 16/128 R |
| 905,201 | 12/1908 | Magnusen | 16/137 |
| 1,412,875 | 4/1922 | Knuth | 16/137 |
| 1,612,656 | 12/1926 | Levy | 16/128 R |
| 2,571,633 | 10/1951 | Vogel | 16/137 |
| 3,231,929 | 2/1966 | Hiltunen et al. | 16/128 R |

*Primary Examiner*—William D. Martin, Jr.
*Attorney, Agent, or Firm*—Clarence A. O'Brien; Harvey B. Jacobson

[57] ABSTRACT

A conventional butt hinge including a pair of first and second relatively swingable superposed hinge leaves is provided and the leaves include registered sets of apertures formed therethrough with the adjacent ends of registered apertures being countersunk. A thick backing plate overlies the side of the first leaf remote from the second leaf and is provided with threaded bores aligned with the registered apertures formed in the leaves. Threaded studs are threadedly engaged in the threaded bores with one set of corresponding ends of the studs flush with the side of the backing plate remote from the hinge and the other set of ends of the threaded studs are sharpened and project outwardly from the ends of the apertures opening outwardly of the side of the second leaf remote from the first leaf. Threaded nuts having rounded opposite ends are threaded onto the studs between the hinge leaves and are received in the countersunk ends of the registered apertures. In use, the second hinge leaf is seated in a door edge mortise and the first hinge leaf is swung into position thereover with the pointed ends of the studs projecting through the apertures of the first leaf and engaged against the door edge in the bottom of the mortise. Then, a hammer or other impact implement is utilized to strike the backing plate to drive the pointed ends of the studs into the door edge forming depressions therein to determine the location of the attaching screw holes to be formed in the door edge.

7 Claims, 4 Drawing Figures

BUTT HINGE SCREW LOCATION MARKING TEMPLATE

BACKGROUND OF THE INVENTION

1. Field of the Invention

Various forms of hinge location tools or gauges have been heretofore designed and some are provided with means to prelocate the positions of screws to be utilized in securing an associated hinge leaf in position. However, these previous tools or templates and gauges are not readily produced for use in conjunction with different forms of hinges. Accordingly, a need exists for a butt hinge template which may be utilized to prelocate positions of screws to be utilized in attaching conventional butt hinge leaves to a door.

2. Description of the Prior Art

Examples of various forms of gauges or templates including some of the general structural and operational features of the instant invention are disclosed in U.S. Pat. Nos. 750,842, 758,636, 1,332,768, 2,812,589, 2,869,245, 2,961,773, 3,307,268 and 3,526,947.

BRIEF DESCRIPTION OF THE INVENTION

The butt hinge screw location marking template of the instant invention is constructed through the utilization of a conventional butt hinge of the type whose attaching screw location is to be marked by the template. In addition to the conventional butt hinge utilized, the only additional components included in the template comprise a backing plate and a plurality of anchor studs in addition to an auxiliary feature comprising an elongated compressible bead of resilient material. It may, therefore, be appreciated that the template of the instant invention may be readily manufactured at a low cost for use in conjunction with substantially all forms and sizes of butt hinges.

The main object of this invention is to provide a butt hinge screw location marking template which may be readily used to mark the locations of attaching screws to be utilized in securing butt hinge leaves in door edge mortises.

Another object of this invention is to provide a template in accordance with the preceding object and which may be readily constructed so as to be usable in conjunction with substantially all types of butt hinges.

Yet another object of this invention is to provide a butt hinge template of a construction and operation which will enable all of the locations of attaching screws to be used in securing a hinge leaf in a door edge mortise to be simultaneously marked in a matter of seconds.

A final object of this invention to be specifically enumerated herein is to provide a template in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
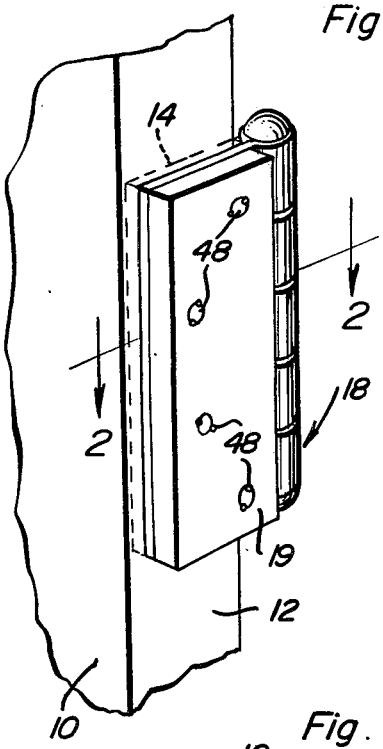
FIG. 1 is a fragmentary, perspective view of a mortised door edge with the template of the instant invention in operative association with the door edge in position to mark the positions of attaching screws to be utilized in securing a butt hinge leaf within the door edge mortise.

Referring now more specifically to the drawings, the numeral 10 generally designates a door to be hung. The door 10 includes a hinge edge 12 having a mortise 14 formed therein. The mortise 14 opens through one side face 16 of the door 10 and is generally rectangular in plan shape.

When a butt hinge leaf is to be secured within the mortise 14, the hinge leaf is conventionally placed within the mortise and a marking tool is at least generally centered relative to the screw receiving apertures formed through the hinge leaf and utilized to mark the door 10 through the hinge leaf apertures. Thereafter, the hinge leaf is removed and a drill is utilized to form pilot bores in the door 10. Thereafter, the hinge leaf is replaced in the mortise 14 and attaching screws are threadedly secured in the pilot bores through the apertures formed in the hinge leaf.

However, premarking the locations in which the pilot bores are to be drilled in this manner often results in the pilot bores being drilled in at least slightly offset positions with the result that the attaching screws subsequently threaded into the pilot bores and tightly against the countersunk apertures formed in the associated hinge leaf are cocked and the heads of the screws, therefore, do not seat flush with the hinge leaf as desired.

The marking template of the instant invention is referred to in general by the reference numeral 18 and comprises a conventional butt hinge 19 including a pair of first and second hinge plates or leaves 20 and 22 having adjacent marginal edge portions pivotally secured together by means of a hinge pin 24 received through barrel portions 26 and 28 carried by the plates 22 and 20, respectively.

The butt hinge 18 is preferably identical to the butt hinge to be used to hang the door 10. The hinge 18 includes registered sets of apertures 30 and 32 formed through the plates 20 and 22 and the adjacent ends of the apertures 30 and 32 are countersunk as at 34 and 36, as is conventional.

The template 18, however, includes a backing plate 38 which overlies the hinge leaf 22 on the side thereof remote from the leaf 20 and the backing plate 38 includes threaded bores 40 formed therethrough in registry with the apertures 32. Threaded studs 42 are threadedly engaged in the bores 40 with one set of corresponding ends thereof flush with the side of the backing plate 38 remote from the hinge leaf or plate 32 and the other set of corresponding ends of the studs 42 project through the apertures 30 and terminate in sharpened terminal ends 44. Threaded nuts 46 are threaded onto the studs 42 between the countersunk adjacent ends of the apertures 30 and 32 and include rounded ends seated in the corresponding counterbores 34 and 36. The nuts 46 are tightened on the studs 42 to clamp the hinge leaf or plate 42 between the nuts 46 and the backing plate 38. In addition, the opposing threaded portions of the backing plate 38 and the studs 42 are deformed as at 48 at the side of the backing plate 38 remote from the hinge leaf or plate 22 in order to prevent rotation of the studs 42 relative to the backing plate 38.

Figure 2:
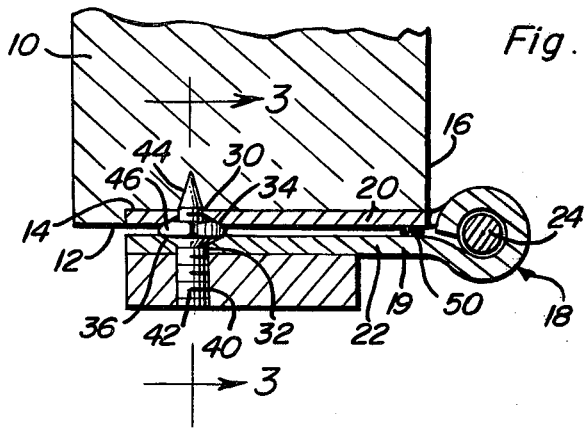
FIG. 2 is an enlarged, fragmentary, horizontal, sectional view taken substantially upon the plane indicated by the section line 2—2 of FIG. 1.
Figure 3:
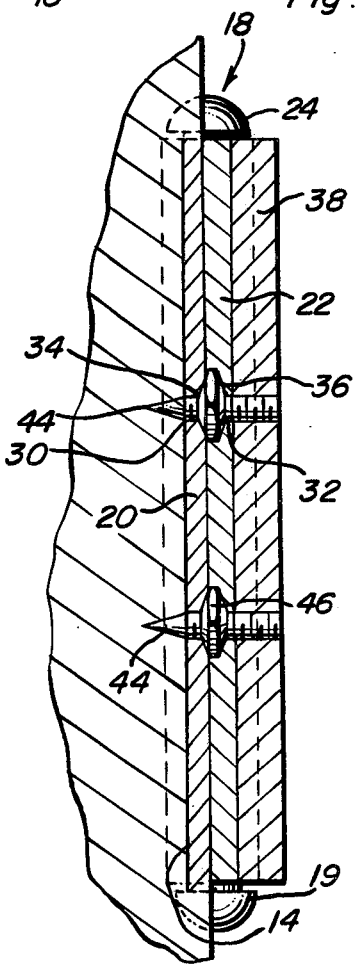
FIG. 3 is a fragmentary, vertical, sectional view taken substantially upon the plane indicated by the section line 3—3 of FIG. 2.
Figure 4:
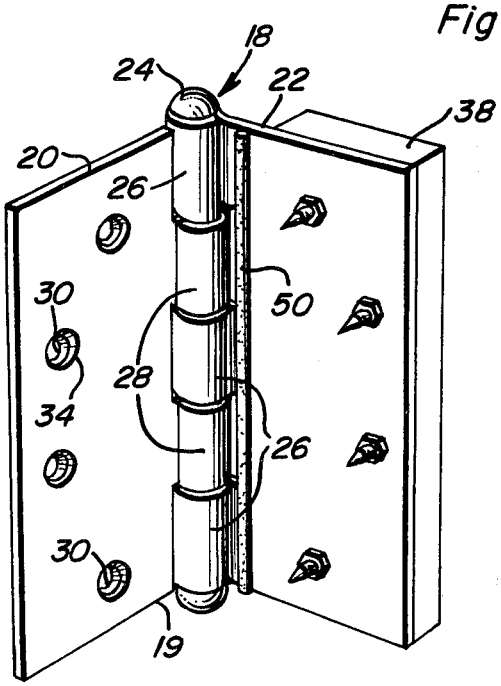
FIG. 4 is a perspective view of the template in an open inoperative position.

It may further be seen from FIG. 4 of the drawings that the marginal edge of the hinge leaf 22 adjacent the barrel portions 26 has a compressible bead 50 of resilient material secured thereto and extending therealong on the side of the hinge leaf 22 adjacent the hinge leaf 20. The bead 50 yieldingly biases the hinge leaf 22 away from the superposed position thereof relative to the hinge leaf 20 illustrated in FIG. 2 of the drawings in order to space the free marginal edges of the hinge leaves 20 and 22 apart.

In operation, after the mortise 14 has been formed in the edge 12 of the door 10, the hinge leaf 20 is seated in the mortise with the hinge leaves 20 and 22 in the open positions thereof illustrated in FIG. 4. Then, the hinge leaf 22 may be swung toward a closed position whereby the pointed extensions or terminal ends 44 of the studs 42 will be projected through the apertures 30 and be engaged with the mortised edge of the door. Then, with the template 18 held in position, an impact tool, such as a hammer, may be utilized to strike the side of the backing plate 38 remote from the hinge leaf 20 in order to forcibly swing the hinge leaf 22 to the fully closed position thereof illustrated in FIG. 2 with the pointed extensions or terminal ends 44 of the studs 42 driven into the door 10. Thereafter, the template 18 may be readily removed and a drill may be utilized to form the pilot bores for the screws to be used in attaching a butt hinge substantially identical to the hinge 19 to the door 10 with one of the leaves of that hinge in proper seated position within the mortise 14. Of course, the depressions made in the door 10 by the extensions 44 positively locate the positions in which the pilot bores are to be drilled and thereby result in the pilot bores for the attaching screws of the hinge to be utilized in hanging the door 10 being perfectly positioned in order that they may fully seat within the counter-bores 34.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A butt hinge screw location marking template comprising a first plate of a plan size and shape to be received within a door edge hinge leaf mortise in predetermined position therein, said plate including a plurality of apertures formed therethrough in a predetermined pattern corresponding to the pattern of mounting screws to be used for securing a door hinge leaf in said mortise, a second plate positionable in superposed registry over one side of said first plate, means pivotally securing corresponding marginal edge portions of said plates together for relative swinging movement of the remote marginal edge portions of said plates toward and away from each other, said second plate including outstanding pointed projections supported therefrom centered relative to and projectable through said apertures to positions projecting outwardly of the side of said first plate remote from said second plate upon swinging of said remote marginal edge portions of said plates together.

2. A butt hinge screw location marking template comprising a first plate of a plan size and shape to be received within a door edge hinge leaf mortise in predetermined position therein, said plate including a plurality of apertures formed therethrough in a predetermined pattern, a second plate positionable in superposed registry over one side of said first plate, means pivotally securing corresponding marginal edge portions of said plates together for relative swinging movement of the remote marginal edge portions of said plates toward and away from each other, said second plate including outstanding projections supported therefrom projectable through said apertures upon swinging of said remote marginal edge portions of said plates together, one of said plates including a compressible resilient bead thereon projecting outwardly from the side thereof opposing the other plate and closely adjacent said one pair of corresponding edge portions and operative to yieldingly bias said plates toward relative positions with said remote marginal edge portions slightly spaced apart.

3. The combination of claim 2 wherein said bead is elongated and generally parallels the axis of relative angular displacement of said plates.

4. The combination of claim 1 wherein said template comprises a standard butt hinge and said plates comprise the leaves of said hinge, said second plate having apertures formed therethrough in registry with the first mentioned apertures, said projections comprising terminal ends of threaded studs secured through the apertures in said second plate, the adjacent ends of said registered apertures including counterbores, nuts threaded on said studs and received in said counterbors, a backing plate overlying the side of said second plate remote from said first plate and in which said studs are threadedly anchored with said second plate clamped between said nuts and backing plates.

5. The combination of claim 1 wherein said terminal ends are pointed.

6. A butt hinge screw location marking template comprising a first plate of a plan size and shape to be received within a door edge hinge leaf mortise in predetermined position therein, said plate including a plurality of apertures formed therethrough in a predetermined pattern, a second plate positionable in superposed registry over one side of said first plate, means pivotally securing corresponding marginal edge portions of said plates together for relative swinging movement of the remote marginal edge portions of said plates toward and away from each other, said second plate including outstanding projections supported therefrom projectable through said apertures upon swinging of said remote marginal edge portions of said plates together, said template comprising a standard butt hinge and said plates comprise the leaves of said hinge, said second plate having apertures formed therethrough in registry with the first mentioned apertures, said projections comprising terminal ends of threaded studs secured through the apertures in said second plate, the adjacent ends of said registered apertures including counterbores, nuts threaded on said studs and received in said counterbore, a backing plate overlying the side of said second plate remote from said first plate and in which said studs are threadedly anchored with said second plate clamped between said nuts and backing plates, one of said plates includes a compressible resilient bead thereon projecting outwardly from the side thereof opposing the other plate and closely adjacent said one pair of corresponding edge portions and operative to yieldingly bias said plates toward relative positions with said remote marginal edge portions slightly spaced apart.

7. The combination of claim 6 wherein said bead is elongated and generally parallels the axis of relative angular displacement of said plates.

* * * * *